US006806445B2

(12) United States Patent
Satoh

(10) Patent No.: US 6,806,445 B2
(45) Date of Patent: Oct. 19, 2004

(54) IMAGE FORMATION APPARATUS AND HEATER CONTROL METHOD

(75) Inventor: Naoki Satoh, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/386,572

(22) Filed: Mar. 13, 2003

(65) Prior Publication Data

US 2003/0178410 A1 Sep. 25, 2003

(30) Foreign Application Priority Data

Mar. 14, 2002 (JP) ..... 2002-069639
Jun. 19, 2002 (JP) ..... 2002-179107
Feb. 13, 2003 (JP) ..... 2003-035661

(51) Int. Cl.[7] ..... H05B 1/02

(52) U.S. Cl. ..... 219/482; 219/481; 219/501; 219/483; 323/31

(58) Field of Search ..... 219/482, 481, 219/485, 501, 486, 497, 505, 499, 494; 323/235, 236, 319, 320

(56) References Cited

U.S. PATENT DOCUMENTS 5,519,190 A * 5/1996 Aoki ..... 219/501
5,747,774 A * 5/1998 Suzuki et al. ..... 219/216
5,783,806 A * 7/1998 Hayasaki ..... 219/635
6,654,572 B2 * 11/2003 Kataoka ..... 399/69

FOREIGN PATENT DOCUMENTS

JP 2000-321920 11/2000

* cited by examiner

*Primary Examiner*—Mark Paschall
(74) *Attorney, Agent, or Firm*—Oblon, Spivak, McClelland, Maier & Neustadt, P.C

(57) ABSTRACT

An image formation apparatus includes a fixing heater, and a zero-cross detector that detects zero-cross points of a frequency of an alternating current (AC) power supply connected to the heater. The image formation apparatus also includes a controller that controls light-on of the heater by pulse-width-modulation (PWM)-controlling the frequency of the AC power supply, that controls a duty width of a PWM control signal for the frequency of the AC power supply for a half period that corresponds to a period between the adjacent zero-cross points detected by the zero-cross detector, and that controls an amplitude of an input current from the AC power supply so that a waveform of the input current becomes a rough approximation of a sine wave.

12 Claims, 9 Drawing Sheets

FIG.6

| | | LATEST FIXING TEMPERATURE | | | | |
|---|---|---|---|---|---|---|
| | | (X-2) DEGREES OR LESS | (X-1)TO(X-2) DEGREES | X DEGREES | (X+1)TO(X+2) DEGREES | (X+2) DEGREES OR MORE |
| PREVIOUS FIXING TEMPERATURE | WITHIN -3 DEGREES | 100 | 100 | 100 | 90 | 70 |
| | WITHIN -2 DEGREES | 90 | 90 | 80 | 70 | 60 |
| | WITHIN ±1 DEGREES | 70 | 60 | 50 | 40 | 30 |
| | WITHIN +2 DEGREES | 20 | 10 | 0 | 0 | 0 |
| | WITHIN +3 DEGREES | 10 | 0 | 0 | 0 | 0 |

FIGURES OF THE TABLE REFER TO DUTY (%) OF PWM SIGNAL

IMAGE FORMATION APPARATUS AND HEATER CONTROL METHOD

BACKGROUND OF THE INVENTION

1) Field of the Invention

The present invention relates to an image formation apparatus and a heater control method for performing light-on control of a heater used in a fixing device by PWM-controlling the frequency of an AC power supply of the heater.

2) Description of the Related Art

Conventionally, a halogen heater is used as a heater for an image formation apparatus. This halogen heater has tungsten filament as well as inert gas filled into a glass tube, and the temperature of this heater is controlled by controlling the current-carrying time of the alternating current (AC) power supply by a semiconductor device such as a triac.

Generally, there are known two types of methods for the temperature control. The first is phase control. The triac is turned on after certain time passes from the zero-cross point of the AC power supply. Thereafter, when the polarity of the triac is inverted, the triac is turned off. By controlling the time (phase angle) from the zero-cross point until the triac is turned on, the temperature of the heater is controlled. The second is ON/OFF control. A half period of the AC power supply is set as a minimum ON/OFF unit, and the heater is not turned on or off halfway along the half period.

As an example of the phase control, there is proposed a power supply control device disclosed in Japanese Patent Application Laid-Open No. 2000-321920. The power supply control device restricts the phase angle of alternating current power supplied based on the temperature detected by a temperature detection unit, to a designated phase angle in supplying power to a heating unit or cutting off the power thereto, thereby suppressing the influence of a rush current, a harmonic current, and fluctuations in power supply voltage over the other equipment when the power is turned on or the power is cut off.

The phase control has a possibility of ensuring highly accurate temperature control. However, since an input current does not take a sine wave, it disadvantageously takes the form of a distorted input current waveform that contains a harmonic current.

Meanwhile, the advantage of the ON/OFF control is in that the waveform of an input current is a sine wave when the input current passes and therefore a harmonic current is smaller in quantity. However, the ON/OFF control has a disadvantage of fluctuations in power supply voltage since the minimum unit of ON/OFF is the half period of the AC power supply.

The power for the fixing heater used in a large-sized copier or a high-speed copier tends to be insufficient. However, if the number of options installed into the copier as a system is small or DC load imposed on the operation thereof is light, it is desirable to supply sufficient power to the fixing heater.

Taking the above into consideration, it is also possible to install an ammeter, to set the power capacity of the fixing device higher, and to accurately control the power by the phase control. If so, the phase control is conducted, which causes a problem to occur such that an input current waveform is distorted as explained above in the conventional method of turning on or off the power by the triac.

Accordingly, the power capacity of the fixing heater is determined so as not to exceed the power specified as that of the system even when the heater is fully lit on. The power for the fixing heater inevitably amounts to the power obtained by subtracting a primary-side power at the time of maximum DC load from the power specified as that of the system.

Moreover, there is known that if the AC power supply connected to the fixing heater is pulse-width-modulation (PWM)-controlled with high frequency, the input current averagely flows during the half period and the waveform of the input current becomes a rough approximation of a sine wave, making it possible to solve the problems of both the harmonic wave and the voltage fluctuation.

SUMMARY OF THE INVENTION

The present invention has been achieved in order to solve the above problems. It is an object of the present invention to obtain an image formation apparatus and a heater control method capable of preventing the input current waveform of an AC power supply connected to a fixing heater from being distorted, suppressing fluctuations in power supply voltage, and supplying maximum power to the fixing heater.

The image formation apparatus according to one aspect of this invention, comprises a heater used in a fixing device, and a detection unit that detects zero-cross points of a frequency of an alternating current (AC) power supply connected to the heater. The image formation apparatus also comprises a control unit that controls light-on of the heater by pulse-width-modulation (PWM)-controlling the frequency of the AC power supply that controls a duty width of a PWM control signal for the frequency of the AC power supply for a half period that corresponds to a period between the two adjacent zero-cross points detected by the detection unit, and that controls an amplitude of an input current from the AC power supply so that a waveform of the input current becomes a rough approximation of a sine wave.

The heater control method according to another aspect of this invention, comprises the step of detecting zero-cross points of a frequency of an AC power supply connected to a heater used in a fixing device. The heater control method also comprises the steps of controlling light-on of the heater by PWM-controlling the frequency of the AC power supply, controlling a duty width of a PWM control signal for the frequency of the AC power supply for a half period that corresponds to a period between the two adjacent zero-cross points detected at the step of detecting, and controlling an amplitude of an input current from the AC power supply so that a waveform of the input current becomes a rough approximation of a sine wave.

These and other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 6 shows one example of a lookup table;

DETAILED DESCRIPTION

Embodiments of the image formation apparatus and the heater control method according to the present invention are explained in detail below with reference to the accompanying drawings.

Figure 1:
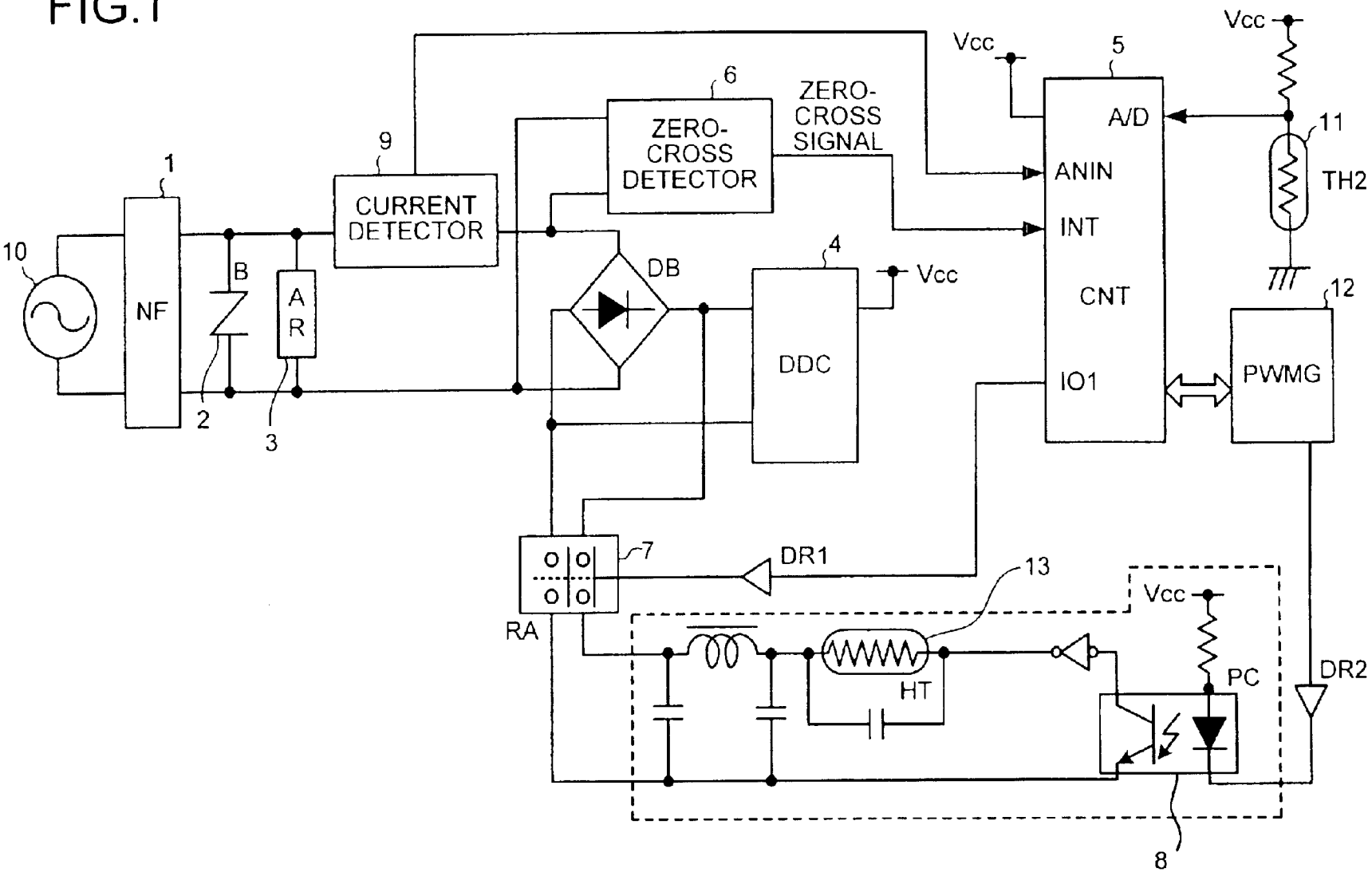
FIG. 1 shows a block diagram of the configuration of a control circuit that controls light-on of a fixing heater in an image formation apparatus in a first embodiment of the present invention.

FIG. 1 shows a block diagram of the configuration of a control circuit that performs light-on control of a heater used in a fixing device (hereinafter, referred to as "fixing heater") in the image formation apparatus as a first embodiment of the present invention. As shown in FIG. 1, a light-on control circuit of the fixing heater in the image formation apparatus of this embodiment mainly comprises a fixing heater (HT) 13, an AC power supply 10 for the fixing heater 13, filters such as a noise filter (NF) 1, a varistor (B) 2, and an arrester (AR) 3, a current detector 9, a zero-cross detector 6, a DC-DC converter (DDC) 4, a controller (CNT) 5, a thermistor (TH2) 11, a PWM generator (PWMG) 12, and a power relay (RA) 7.

Power is input from the AC power supply 10 for the fixing heater through the filters such as the noise filter (NF) 1, the varistor (B) 2, and the arrester (AR) 3, and protective elements. A direct current (DC) power supply used for the main body of the image formation apparatus outputs Vcc power to be supplied by the DC-DC converter (DDC) 4 after forming a diode bridge, to the main body controller (CNT) 5 that includes a temperature control function for fixing, the other controller (not shown), and the like.

The current detector 9 detects a primary-side current of the AC power supply 10, and inputs the primary-side current thus detected to the controller 5.

The zero-cross detector 6 generates a zero-cross signal used for temperature control for fixing from an AC input voltage, and outputs the zero-cross signal thus generated to the interrupt input or input port (INT) of the controller 5.

The thermistor (TH2) 11 provided on the surface of a fixing roller (not shown), detects the temperature of the fixing heater (HT) 13, and outputs the detected temperature signal to the controller 5.

The controller 5 monitors temperature by the temperature detection thermistor (TH2) 11. If the present surface temperature of the fixing roller is lower than a preset target temperature, the controller 5 increases the duty width of a PWM control signal. If it is higher than the preset target temperature, the controller 5 decreases the duty width of the PWM control signal. By doing so, the controller 5 controls a current passed to the fixing heater (HT) 13.

In addition, the controller 5 inputs the zero-cross signals detected by the zero-cross detector 6, and determines a period between the two adjacent zero-cross signals thus input as a half period of the input current. The controller 5 further controls the PWM control signal so that the duty width of the PWM control signal does not change during the half period of the input current.

The PWM generator (PWMG) 12 generates a PWM signal according to the duty width of the PWM control signal determined by the controller 5, and outputs the generated PWM signal to a photo coupler (PC) 8, thereby the fixing heater (HT) 13 is turned on or off. Accordingly, the quantity of the heat generated from the fixing heater (HT) 13 is controlled, and the surface temperature of the fixing roller becomes the target temperature.

The power relay (RA) 7 functions to shut off an output signal from the controller 5 when the image formation apparatus malfunctions, and shuts off the supply of power to the fixing heater (HT) 13. The photo coupler (PC) 8 isolates the signal between the controller 5 and a primary circuit.

Figure 2:
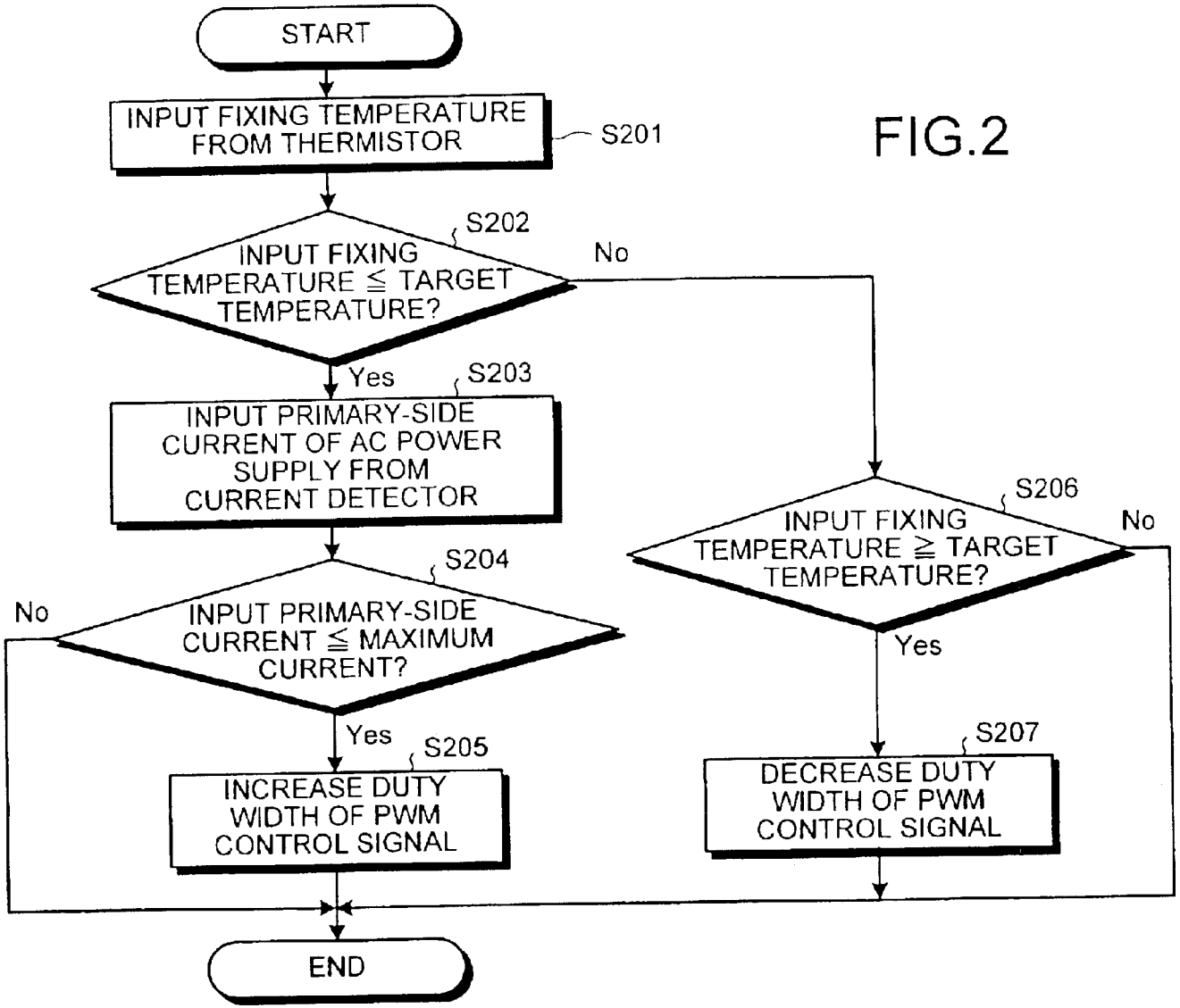
FIG. 2 is a flow chart of processing procedures for light-on control of a fixing heater conducted by a controller.

The light-on control of the fixing heater conducted by the controller 5 of the image formation apparatus in this embodiment constituted as explained above will next be explained. FIG. 2 is a flow chart of processing procedures for the light-on control of the fixing heater conducted by the controller 5.

The controller 5 first monitors the temperature of the fixing roller ("fixing temperature") using the thermistor 11, and inputs the fixing temperature from the thermistor 11 (step S201). The controller 5 then determines whether the input fixing temperature is not more than the target temperature (step S202).

The controller 5 monitors the primary-side current of the AC power supply 10 based on an input from the current detector 9. If the fixing temperature is not more than the target temperature, the controller 5 inputs the primary-side current from the current detector 9 (step S203), and determines whether the primary-side current is not more than the maximum current (step S204).

If the primary-side current is not more than the maximum current, the controller 5 outputs a signal indicating an increased duty width of the PWM control signal, to the PWM generator 12 (step S205). As a result, the amplitude of the input current waveform increases.

In the temperature control of the fixing heater, the duty width of the PWM control signal indicating a light-on rate of the fixing heater is determined according to a difference between the preset target temperature and the present fixing temperature calculated from the present resistance of the fixing thermistor. The determination method includes a determination method by using an arithmetic processing or a lookup table.

In the determination method using the arithmetic processing, the duty width of the PWM control signal is generally determined according to the following equation.

(Duty width of next PWM control signal)=[(target fixing temperature)−(present fixing temperature)]×control coefficient+(duty width of previous PWM control signal).

As for the lookup table used for the determination method, a lookup table shown, for example, in FIG. 6 can be used.

On the other hand, if it is determined at step S204 that the primary-side current is higher than the maximum current, the controller 5 does not change the duty width of the PWM control signal. That is, the controller 5 outputs the PWM control signal having the present duty width to the PWM generator 12.

If it is determined at step S202 that the fixing temperature is higher than the target temperature, the controller 5 determines whether the fixing temperature input to the controller 5 is not less than the target temperature (step S206). If the input fixing temperature is not less than the target temperature, the controller 5 outputs the PWM control signal after decreasing the duty width thereof to the PWM generator 12 (step S207). As a result, the amplitude of the input current waveform is lowered.

If the input fixing temperature is lower than the target temperature, that is, the input fixing temperature is equal to the target temperature, the fixing temperature already reaches the target temperature. Therefore, the controller 5 does not change the duty width of the PWM control signal. That is, the controller 5 outputs the PWM control signal having the present duty width to the PWM generator 12.

The control procedures from the steps S201 to S207 explained above are performed when the zero-cross signal is input. During the half period of the input current that is a period between the inputs of the two adjacent zero-cross signals, the duty width is not changed.

Consequently, the quantity of the heat generated from the fixing heater is controlled, and the surface temperature of the fixing roller is controlled to be equal to the target temperature.

Figure 3:
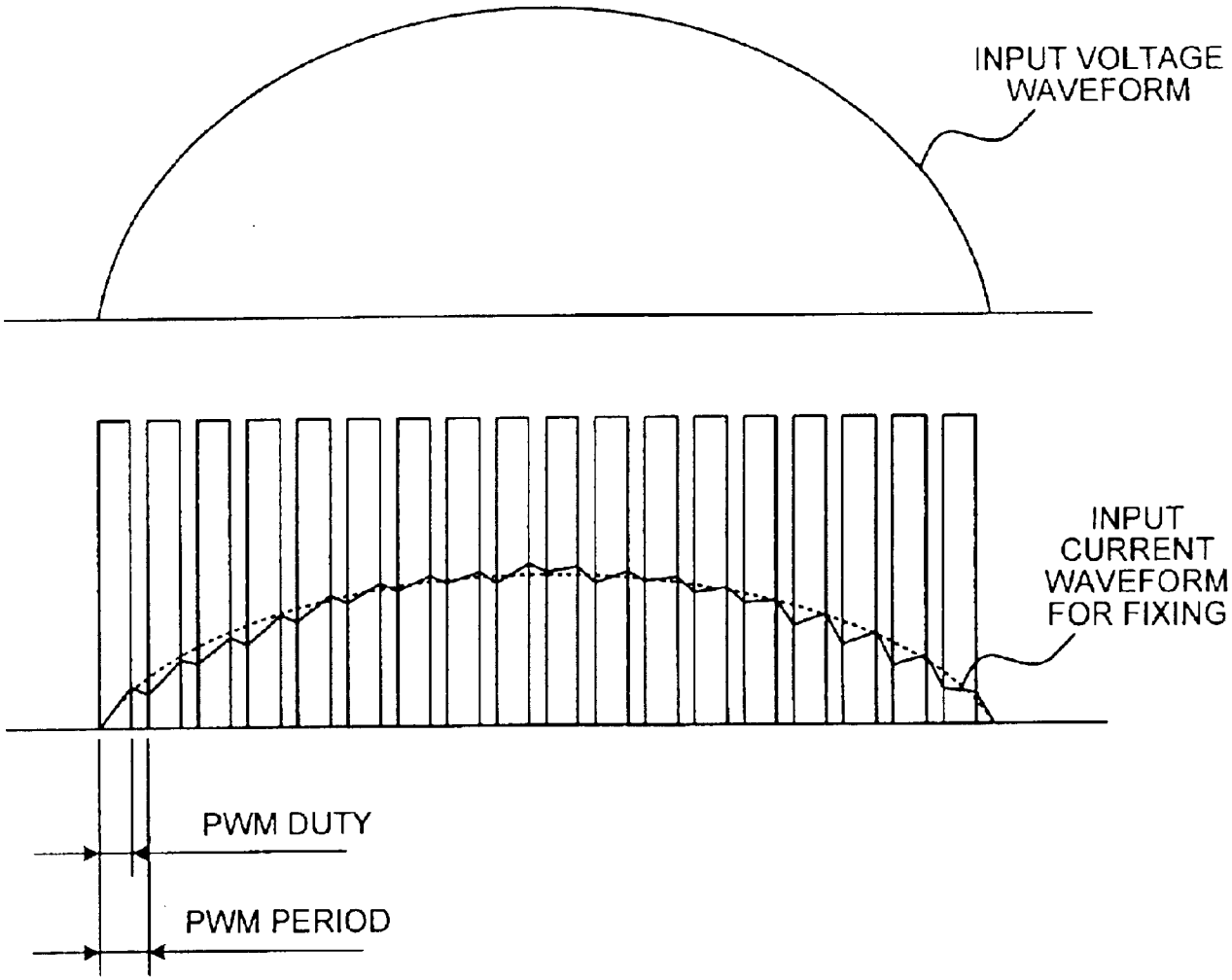
FIG. 3 shows the state of an input voltage waveform and that of a fixing input current waveform if the duty width of the PWM control signal is large.
Figure 4:
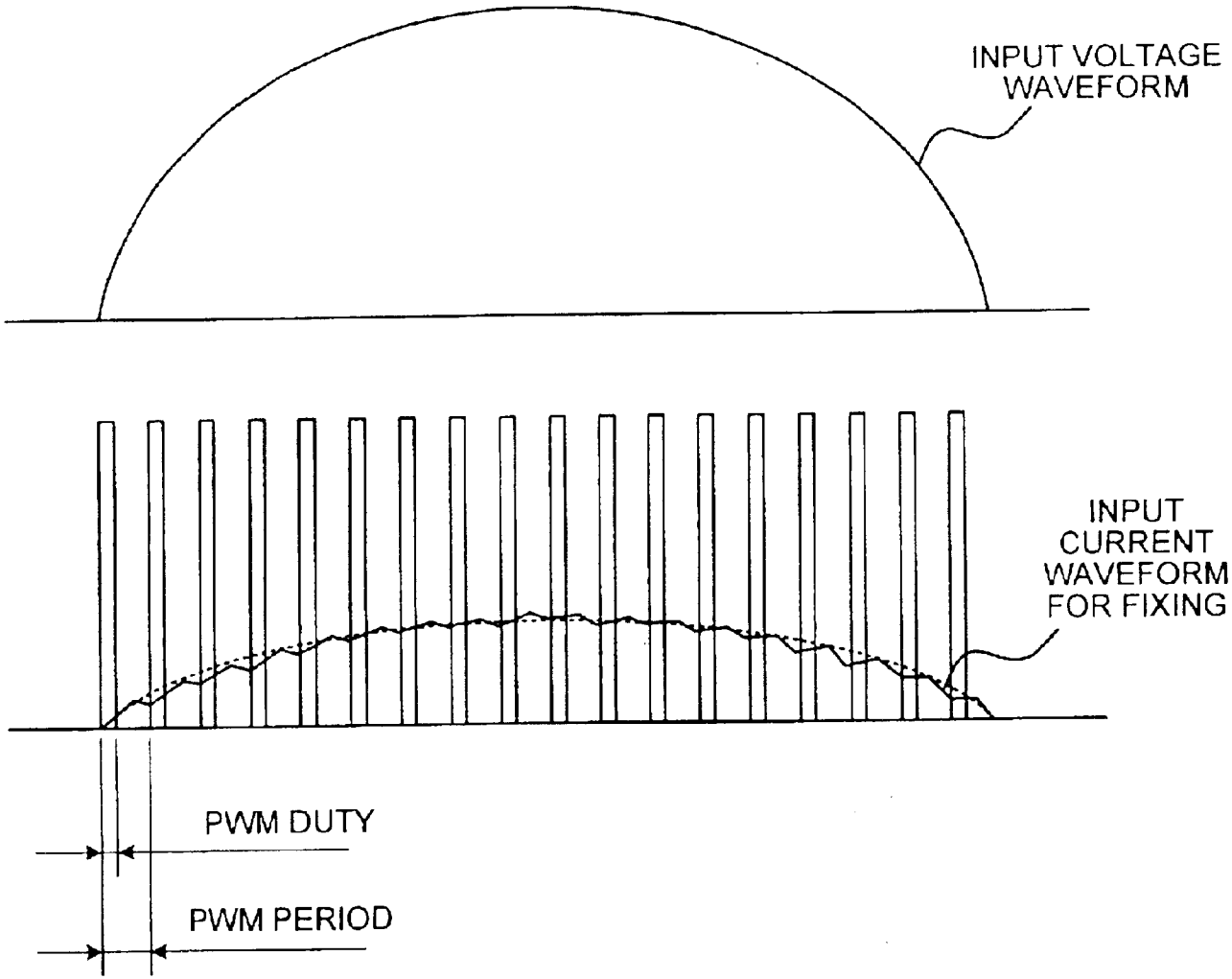
FIG. 4 shows the state of an input voltage waveform and that of a fixing input current waveform if the duty width of the PWM control signal is small.

FIG. 3 and FIG. 4 show input current waveforms for fixing. FIG. 3 shows the waveform when the duty width of the PWM control signal for the PWM signal is large, whereas FIG. 4 shows the waveform when the duty width thereof is small. As shown in FIG. 3, if the PWM control signal is controlled to increase its duty width, the amplitude of the input current waveform increases. As shown in FIG. 4, if the PWM control signal is controlled to decrease its duty width, the amplitude of the input current waveform lowers. Further, as shown in FIGS. 3 and 4, a current close to a sine wave flows as the AC input current, and therefore it is possible to prevent both the power supply voltage from fluctuating and the input current waveform from becoming a harmonic waveform. Thus, the input current flows averagely during the half period, and it is possible to supply the maximum power to the fixing heater without distorting the input current waveform.

Figure 5:
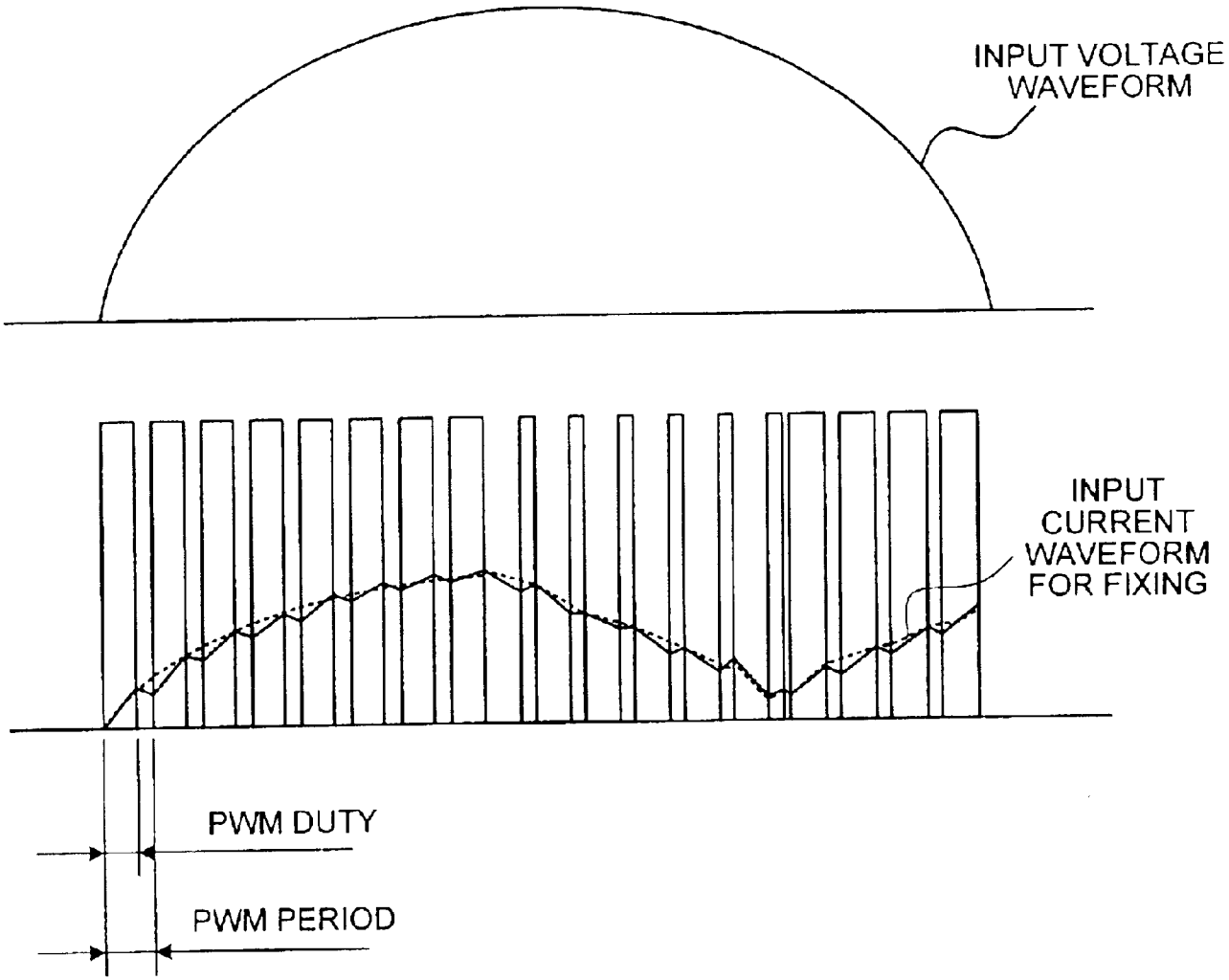
FIG. 5 shows the state of the input voltage waveform and that of the fixing input current waveform if the duty width of the PWM control signal is changed midway along the half period of the input current of an AC power supply.

If the duty width of the PWM control signal is changed at the period between the zero-cross points, that is, midway along the half period of the input current of the AC power supply 10, the input current is distorted and a harmonic current is generated. FIG. 5 shows the state of the current waveform when the duty width of the PWM control signal is changed midway along the half period of the input current of the AC power supply 10. As can be seen from FIG. 5, the input current is distorted and the harmonic current is generated.

In this embodiment, during the half period of the input current, the duty width of the PWM control signal is kept constant. Therefore, the distortion of the input current waveform can be avoided.

Figure 7:
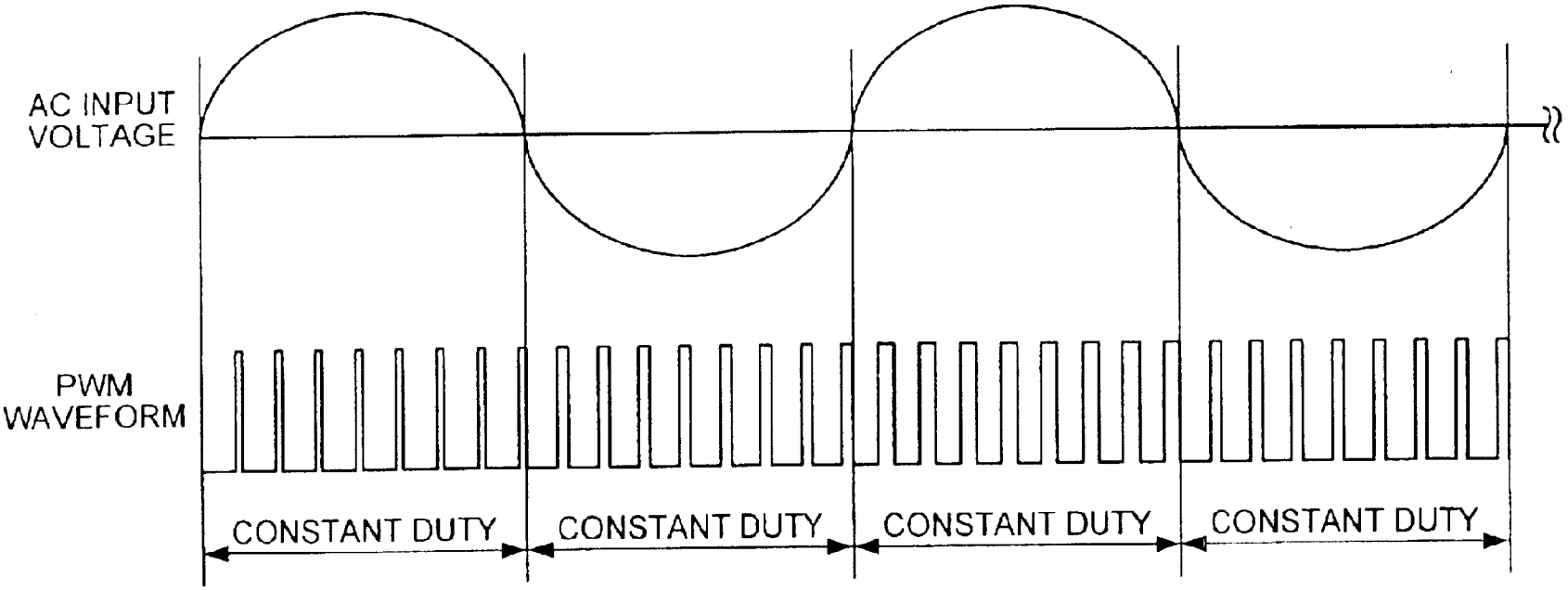
FIG. 7 shows the state of the voltage waveform if the duty width of the PWM control signal is kept constant during the half period of the input current of the AC power supply.

The controller 5 monitors the temperature in a polling period sufficiently shorter than the zero-cross period or generates an interrupt by a zero-cross signal, and determines the duty width of the PWM control signal at each zero-cross point to update the duty width. As shown in FIG. 7, during the half period of the AC input voltage, the controller 5 keeps the duty width of the PWM control signal constant, thereby making it possible to ensure accurate temperature control without generating a harmonic current. FIG. 7 shows the state of a voltage waveform if the duty width of the PWM control signal is kept constant during the half period of the input voltage of the AC power supply 10.

In the first embodiment, the current detector 9 is provided to allow the primary-side current of the AC power supply to be input to the controller 5. Alternatively, the current detector 9 is not provided and the current may be determined in advance in each operation mode such as a copy operation or a print operation so as to input a current corresponding to the present operation mode to the controller 5.

The image formation apparatus in a second embodiment is configured to control to increase the duty width of the PWM control signal step by step at half-period intervals. Since the configuration of the control circuit in this embodiment is the same as that in the first embodiment, it will not be explained herein repeatedly.

Figure 8:
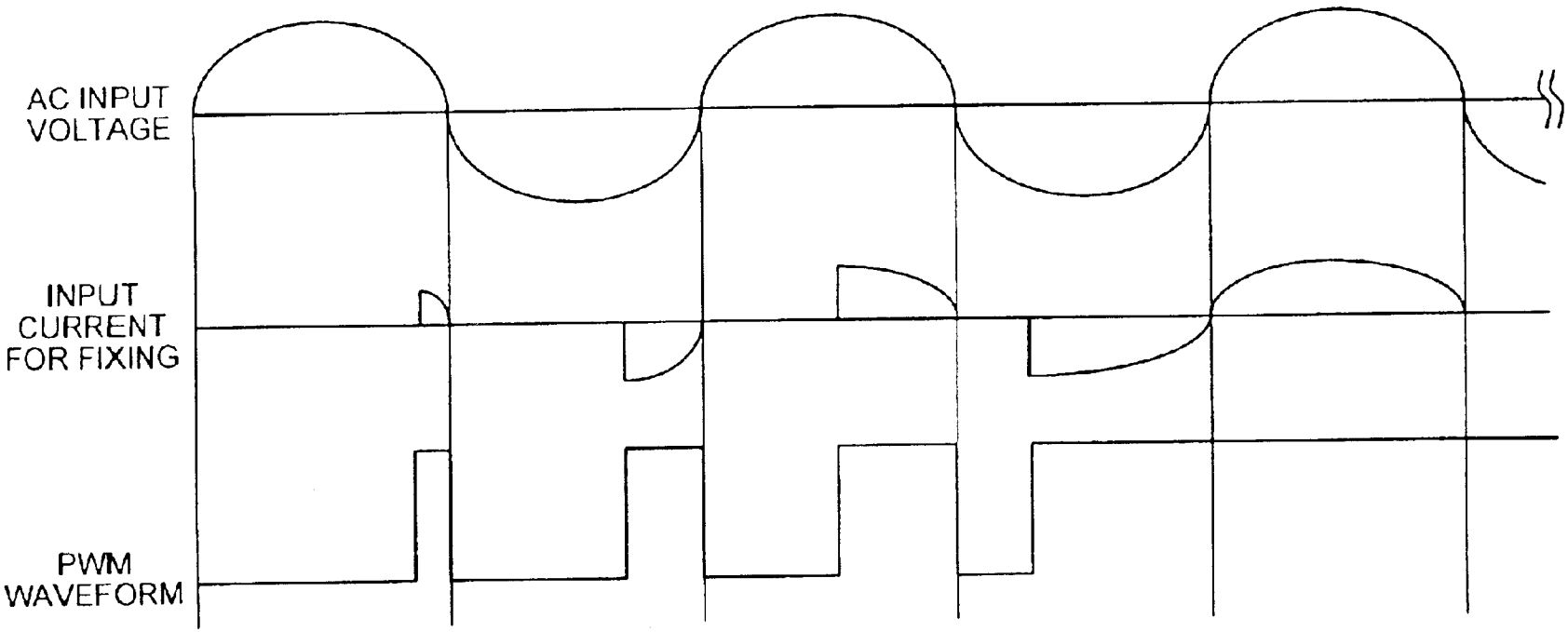
FIG. 8 shows the state of the input voltage waveform and that of the current waveform if phase control is conducted.

It is known that a high rush current is carried to the fixing heater (HT) 13 when power is turned on because the internal resistance of the fixing heater (HT) 13 lowers at low temperature. According to the phase control method explained above, soft start that a phase angle is increased gradually or step by step can be conducted, thus making it possible to prevent a high rush current. In addition, by controlling the phase angle minutely, it is possible to ensure further accurate temperature control. If the phase control is conducted, the AC input current does not become a sine wave. FIG. 8 shows the state of the current waveform when the phase control is conducted. As shown in FIG. 8, if the phase control is conducted, the AC input current takes a waveform including that of a harmonic current.

Figure 9:
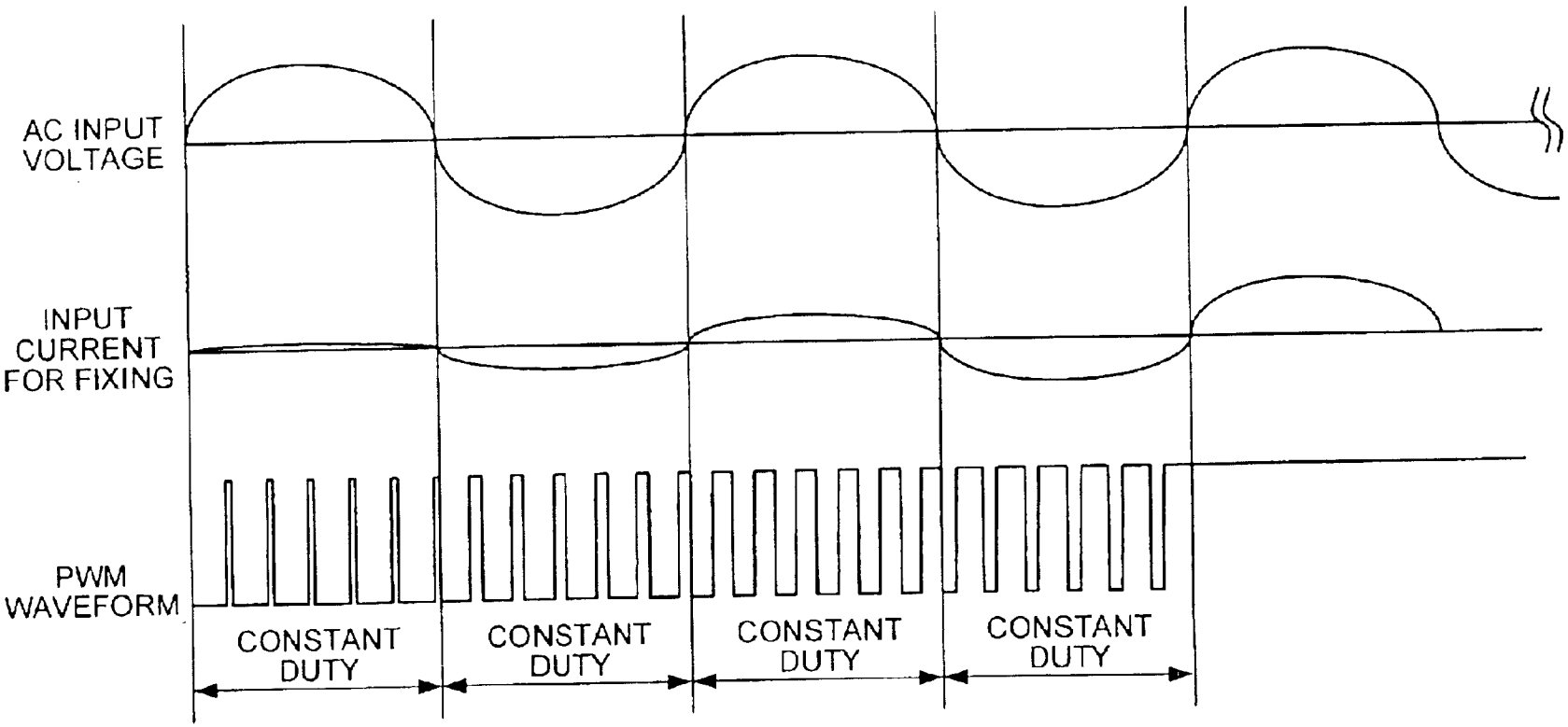
FIG. 9 shows the state of the input voltage waveform when power is turned on and the state of the current waveform if the duty width of the PWM control signal is controlled to be increased step by step.

In this embodiment, the controller 5 in the image formation apparatus changes the duty width of the PWM control signal at half-period intervals, thereby increasing the duty width of the PWM control signal step by step. FIG. 9 shows the state of the current waveform if the controller 5 controls the duty width of the PWM control signal to be increased step by step when power is turned on. By so controlling, it is possible to suppress the rush current without generating the harmonic current and distorting the waveform.

In the second embodiment, the controller 5 controls the duty width of the PWM control signal to be increased when the power for the image formation apparatus is turned on. Alternatively, it is possible to control the duty width to be increased step by step during operations other than the time when the power is turned on. In the latter case, it is possible to prevent the input current waveform of the AC power supply from including the harmonic current and being distorted.

As explained so far, according to the present invention, the zero-cross points of the frequency of the AC power supply connected to the heater used in the fixing device are detected, the frequency of the AC power supply is PWM-controlled to thereby control the light-on of the heater, the duty width of the PWM control signal for the frequency of the AC power supply is controlled for the half period that corresponds to the period between the adjacent zero-cross points thus detected, and the amplitude of the input current is controlled so that the waveform of the input current from the AC power supply becomes a rough approximation of a sine wave. Therefore, it is advantageous that the input current can be averagely passed during the half period and the maximum power can be supplied to the fixing heater without distorting the input current waveform.

According to the present invention, the duty width of the PWM control signal of the heater is controlled so as to be kept fixed during the half period that corresponds to the period between the two adjacent zero-cross points thus detected. Therefore, it is advantageously possible to prevent a harmonic current from being generated in the input current from the AC power supply connected to the heater.

According to the present invention, by controlling the duty width of the PWM control signal to be increased step by step, it is advantageously possible to prevent the input current waveform of the AC power supply connected to the heater from being distorted. By thus controlling particularly when power is turned on, it is advantageously possible to suppress a rush current without generating a harmonic current and distorting the input current waveform.

The present document incorporates by reference the entire contents of Japanese priority documents, 2002-069639 filed in Japan on Mar. 14, 2002, 2002–179107 filed in Japan on Jun. 19, 2002 and 2003-035661 filed in Japan on Feb. 13, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus comprising:

a heater used in a fixing device;

a detection unit that detects zero-cross points of a frequency of an alternating current (AC) power supply connected to the heater; and a control unit that controls light-on of the heater by pulse-width-modulation (PWM)-controlling the frequency of the AC power supply, controls a duty width of a PWM control signal for the frequency of the AC power supply for a half period that corresponds to a period between the zero-cross points adjacent to each other detected by the detection unit, and controls an amplitude of an input current from the AC power supply so that a waveform of the input current becomes a rough approximation of a sine wave.

2. The image formation apparatus according to claim 1, wherein the heater is used in the fixing device having a power capacity higher than a capacity of power obtained by subtracting a first amount of primary-side maximum consumption power used for a direct current load, from a second amount of primary-side maximum consumption power, and the control unit further controls the light-on of the heater so as not to exceed the second amount of primary-side maximum consumption power.

3. The image formation apparatus according to claim 2, further comprising a current detection unit that detects a current on a primary side of the AC power supply, wherein the control unit further controls the light-on of the heater so as not to exceed maximum consumption power on the primary side detected by the current detection unit.

4. The image formation apparatus according to claim 1, wherein the control unit further PWM-controls the frequency of the AC power supply for the heater with a higher frequency than the frequency of the AC power supply.

5. The image formation apparatus according to claim 1, wherein the control unit controls the duty width of the PWM control signal for the heater so as to be kept fixed during the half period that corresponds to the period between the zero-cross points adjacent to each other detected by the detection unit.

6. The image formation apparatus according to claim 1, wherein the control unit controls the duty width of the PWM control signal so as to be increased step by step.

7. A heater control method comprising the steps of:

detecting zero-cross points of a frequency of an alternating current (AC) power supply connected to a heater used in a fixing device; and controlling light-on of the heater by pulse-width-modulation (PWM)-controlling the frequency of the AC power supply, controlling a duty width of a PWM control signal for the frequency of the AC power supply for a half period that corresponds to a period between the zero-cross points adjacent to each other detected at the step of detecting, and controlling an amplitude of an input current from the AC power supply so that a waveform of the input current becomes a rough approximation of a sine wave.

8. The heater control method according to claim 7, wherein at the step of controlling, the light-on of the heater is further controlled so as not to exceed maximum consumption power on a primary side of the AC power supply.

9. The heater control method according to claim 8, further comprising a step of detecting a current on the primary side of the AC power supply, wherein at the step of controlling, the light-on of the heater is further controlled so as not to exceed maximum consumption power on the primary side detected at the step of detecting the current.

10. The heater control method according to claim 7, wherein at the step of controlling, the frequency of the AC power supply for the heater is further PWM-controlled with a higher frequency than the frequency of the AC power supply.

11. The heater control method according to claim 7, wherein at the step of controlling, the duty width of the PWM control signal for the heater is controlled so as to be kept fixed during the half period that corresponds to the period between the zero-cross points adjacent to each other detected at the step of detecting the zero-cross points.

12. The heater control method according to claim 7, wherein at the step of controlling, the duty width of the PWM control signal is controlled so as to be increased step by step.

* * * * *

UNITED STATES PATENT AND TRADEMARK OFFICE

CERTIFICATE OF CORRECTION

PATENT NO. : 6,806,445 B2
DATED : October 19, 2004
INVENTOR(S) : Sato

It is certified that error appears in the above-identified patent and that said Letters Patent is hereby corrected as shown below:

Title page,
Items [12] and [75], should read as follows:

-- [12] United States Patent
Sato --
[75] Inventor: Naoki Sato, Chiba (JP) --

Signed and Sealed this

First Day of February, 2005

JON W. DUDAS
*Director of the United States Patent and Trademark Office*